US011261047B2

(12) United States Patent
Leuenberger

(10) Patent No.: US 11,261,047 B2
(45) Date of Patent: Mar. 1, 2022

(54) SYSTEM FOR DELIVERING PRINTED PRODUCTS OF IDENTICAL OR DIFFERENT THICKNESS AND METHOD FOR THEIR TRANSFER TO A DELIVERY SYSTEM

(71) Applicant: Mueller Martini Holding AG, Hergiswil (CH)

(72) Inventor: Lukas Leuenberger, Schoeftland (CH)

(73) Assignee: MUELLER MARTINI HOLDING AG, Hergiswil (CH)

( * ) Notice: Subject to any disclaimer, the term of this patent is extended or adjusted under 35 U.S.C. 154(b) by 218 days.

(21) Appl. No.: 16/517,697

(22) Filed: Jul. 22, 2019

(65) Prior Publication Data

US 2020/0031601 A1 Jan. 30, 2020

(30) Foreign Application Priority Data

Jul. 25, 2018 (CH) ..... 00919/18

(51) Int. Cl.
*B65H 29/00* (2006.01)

(52) U.S. Cl.
CPC ... *B65H 29/003* (2013.01); *B65H 2301/4354* (2013.01); *B65H 2301/4473* (2013.01); *B65H 2301/44712* (2013.01)

(58) Field of Classification Search
CPC .. B65H 2301/44712; B65H 2301/4354; B65H 2301/4473; B65H 2404/6591; B65H 2301/4479; B65H 2301/142; B24B 9/04
See application file for complete search history.

(56) References Cited

U.S. PATENT DOCUMENTS 3,366,225 A * 1/1968 Thorp ..... B42B 2/02 270/60
4,164,159 A 8/1979 Marciniak
4,498,663 A 2/1985 Wamsley et al.
5,673,910 A * 10/1997 Wamsley ..... B65H 5/062 198/624
6,095,740 A 8/2000 Hollenstein et al.
(Continued)

FOREIGN PATENT DOCUMENTS

EP 0716999 A1 6/1996
EP 0893275 A1 1/1999
EP 2860039 A1 4/2015

*Primary Examiner* — Jennifer Bahls
(74) *Attorney, Agent, or Firm* — Leydig, Voit & Mayer, Ltd.

(57) ABSTRACT

A system has: a transport chain, which is roof-shaped in an upper region, along which printed products are transportable astride, collectable, and optionally stitchable in an intermediate stitching station; and a stop, which is adjustable in accordance with a format of a printed product of the printed products being delivered, is arranged in a transport direction of the printed products, and is positioned after the intermediate stitching station along the transport chain, the stop corresponding to a location of delivery of the printed product from the transport chain. A cyclic transfer of the printed product during the delivery takes place via a delivery system, the delivery system having in an infeed region a printed product transporter configured to transfer the printed product being delivered, the printed product transporter having pivot arms, the pivot arms being controllable according to a measured thickness of the printed product being delivered.

32 Claims, 7 Drawing Sheets

(56) References Cited

U.S. PATENT DOCUMENTS

| | | | | |
|---|---|---|---|---|
| 6,277,059 | B1 * | 8/2001 | Groenenberg | B65H 9/04 493/37 |
| 6,994,337 | B1 * | 2/2006 | Cracknell | B26D 1/08 270/52.26 |
| 2008/0028961 | A1 * | 2/2008 | Doucet | B65G 29/00 101/232 |
| 2014/0044501 | A1 * | 2/2014 | Arendt | B65H 5/32 412/6 |

* cited by examiner

1000

SYSTEM FOR DELIVERING PRINTED PRODUCTS OF IDENTICAL OR DIFFERENT THICKNESS AND METHOD FOR THEIR TRANSFER TO A DELIVERY SYSTEM

CROSS-REFERENCE TO PRIOR APPLICATIONS

Priority is claimed to Swiss Patent Application No. CH 00919/18, filed on Jul. 25, 2018, the entire disclosure of which is hereby incorporated by reference herein.

FIELD

The present invention relates to a system for delivering printed products of identical or different thickness and a method for their transfer to a delivery system.

BACKGROUND

Digitalization is increasingly also taking over the printing industry. In the printing industry, terms such as "Print 4.0" or "Web to Print" are connected with the topic of "Industry 4.0." These terms aim to point out production machines by means of which a run size=1 can be processed without loss of quality. In order for such production machines to fulfill these requirements, communication flows should be established to superordinate systems, which continuously provide the necessary control data. Thus, these production machines are designed in such a way that the "on-the-fly" settings can apply to any production cycle.

In existing solutions, there is no thickness adjustment for the printed products. The product thickness is compensated for via flexible strips, in the sense of a cushioning effect. The disadvantage in this respect is that the transfer position initiated by the delivery system changes with different product thicknesses. Consequently, a thicker printed product is picked up earlier and, with respect to a narrower printed product, picked up later. This in turn changes the horizontal position in the saddle chain direction depending on the printed product thickness.

Another solution consists in adjusting a first infeed roller to be fixed, while a second infeed roller can be advanced and moved away via a pivot arm, whereby, in principle, a rudimentary adaptation to the respective printed product thickness may be achieved. In the case of jams or other accidents, the flexibility here merely lies in the fact that, in case of "on-the-fly" operation, the second roller can be completely opened. The disadvantage of this solution is that the center of the infeed wedge shifts. This means that the center thereof does not always correspond to the center of the saddle chain, or of the ejector blade. As a result, the ejector blade operatively connected to the delivery system must be able to unfold in the horizontal position (perpendicular to the saddle chain direction). This in turn results in the further disadvantage that the front and rear side of the printed product cannot simultaneously engage in the conveyor belts of the delivery system.

From U.S. Pat. No. 4,164,159 A is known a system in which the transfer arrangement contains a lifting blade which is moved from a retracted position within the saddle into an extended position. As the lifting blade moves upward to the extended position, it lifts the folded edge portion of a printed product upward into a gap formed between a plurality of cylindrical feed rollers and a plurality of rotatable roller segments. These roller segments work together with the feed roller to exert a clamping force on the opposite sides of the printed product to then firmly grip it and move it upward to a second gap formed between a plurality of pressure rollers and the feed rollers. The pressure rollers and the feed rollers are capable of applying a clamping force to the opposite sides of the signature in order to grip the printed product as it moves upward from the saddle.

SUMMARY

An embodiment of the present invention provides a system, preferably a saddle stitcher, having: a transport chain, which is roof-shaped in an upper region, along which one or more printed products are transportable astride, collectable, and optionally stitchable in an intermediate stitching station; and a stop, which is adjustable in accordance with a format of a printed product of the printed products being delivered, is arranged in a transport direction of the printed products, and is positioned after the intermediate stitching station along the transport chain, the stop corresponding to a location of delivery of the printed product from the transport chain. A cyclic transfer of the printed product during the delivery takes place via a delivery system, the delivery system having in an infeed region a printed product transporter configured to transfer the printed product being delivered, the printed product transporter having pivot arms, the pivot arms being controllable according to a measured thickness of the printed product being delivered.

DETAILED DESCRIPTION

Figure 1:
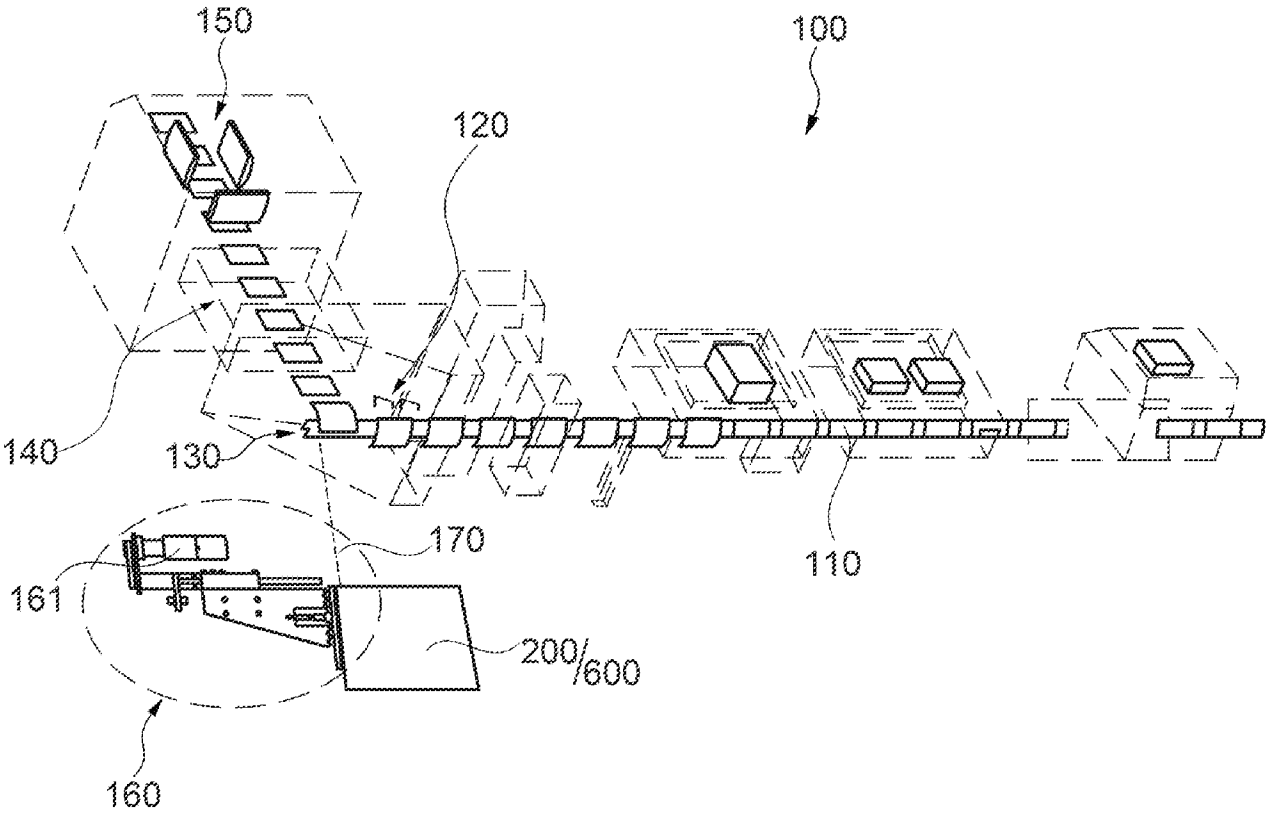
FIG. 1 shows an overall view of a saddle stitcher, highlighting a stop.

Embodiments of the present invention relate to a system, preferably designed as a saddle stitcher, which substantially consists of a transport chain which is configured in a roof-shaped form in the upper region and along which one or more printed products, preferably configured as folded sheets, being transported astride, collected, and preferably stitched as booklet in an intermediate stitching station. This type of transport can also be used for non-stitched assembled printed products, where these products can also be present in the form of a set of folded sheets. These folded sheets are generally transported along the transport chain designed as a saddle chain to a stopping point, and these folded sheets are then conducted further from there via at least one feeding device, also called "delivery system," to a cutting apparatus, in which the folded sheets, or the booklet assembled therefrom, are cut to format.

Embodiments of the present invention enable the synchronous transfer of a printed product to the delivery system, which is also simultaneously regulated to the different thicknesses of such a printed product in time with the cycle so that both the transfer and further transport of the printed product are arranged individually.

Below are definition of terms used in the application:

Folded sheet (sheet): A folded sheet, a partial product of the printed sheet (paper printed on both sides) consisting of a plurality of sheet parts.

Booklet: A printed product consisting of at least one or more folded sheets.

Staple: Consisting of wire, which obtains this form in a first step and which is pushed through the booklet and subsequently bent.

Stitching head: Cuts and positions the staple wire and forms the staple wire into a staple.

Stitching process: Process in which at least one staple is pushed through the booklet and closed at the other end.

Stitching carriage: Part of the stitching station on which the stitching heads are mounted.

Stitching station: Stitches a product by means of a staple while the stitching carriage is in synchronism with the transport chain.

Product: Consists of at least one folded sheet which is assembled into a booklet.

Variable thickness: Pick-up of booklets and/or sheet parts of different thicknesses.

Cutting apparatus: Cutting system that has a front blade and two side blades and performs the cutting process, consisting of a front cut and a head-foot cut as a subsequent cut.

Saddle stitcher: In a saddle stitcher, several folded sheets are typically collected on a transport chain, stitched in the stitching station, and cut on three sides in the cutting apparatus.

Saddle chain: The saddle chain has a guide device, the upper section of which is formed to be blade-shaped and the ridge line of which defines the transport and stitching line, and an essentially roof-shaped support, on which the sheet sections are transported astride.

Delivery system: Machine component that transports the products after the stitching station into the feed to the cutting apparatus. In the delivery system, the transport direction changes by 90° to the front or to the rear depending on the position of the cutting apparatus.

Product feed: Conveyor belt which transfers products after the delivery system into the cutting apparatus. The conveyor belt has mechanical stops which move synchronously with the cutting apparatus.

Ejection phase, eject: By means of a device, called an ejector, the product is lifted from the saddle chain until it is picked up by the conveyor belts in the delivery system and transported further in the delivery system.

On-the-fly: Changes, for example of settings, positions of devices, etc., possible during operation.

MIS: In conjunction with the term "Industry 4.0," terms, such as "Finishing 4.0," "Print 4.0" or "Web to Print" are known in the printing industry. This basically refers to the digital transformation of the IT sector and production technology. Management information systems are required in order to achieve these objects.

Embodiments of the present invention overcome certain disadvantages of the state of the art, including enabling on-the-fly adjustment due to changes in product thickness. Embodiments of the present invention fulfill one or more of the following appliance-specific criteria, namely:

1) Positioning: The printed product is clearly defined in a horizontal position with respect to the transport direction (saddle chain);

2) Stopping the printed product: In the case that kinetic energy (residual velocity) still exists in the transport direction, it is completely neutralized in the immediate area of a stop; and 3) Stabilization: The printed product is stabilized during the ejection phase into the delivery system, i.e. a possible canting and/or tilting moment is thus absorbed or suppressed by the position assumed by the stop.

Embodiments of the present invention also enable adjusting the infeed rollers of the delivery system depending on the respectively measured thickness of the printed product, even during each production cycle if required.

The following is thus achieved by embodiments of the present invention:

a) The movement of the infeed rollers is symmetrical;

b) The adjustment is automated such that manual intervention is no longer necessary; and c) The controller transmits corresponding signals to actuators, which adjusts the infeed rollers closely to the thickness of the respective printed product present. These actuators may be in the form of electric motors, servomotors, hydraulically or pneumatically powered drives, etc. The provisions for detecting the thickness variability for each individual printed product (cycle-to-cycle) are implemented, and this detection also includes corrections, which flow in "on-the-fly."

All the underlying criteria of the embodiments of the present invention extend to the entire operative speed range of the system, to all format sizes and thicknesses of the printed products, and to the behavior of the respective paper material of which the individual folded sheets consist.

Advantages enabled by the present invention are achieved due to a number of units of this system acting interdependently with one another, as described further below.

The printed products formed with a number of folded sheets or the booklet formed therefrom (see list of definitions) rest on a saddle-shaped saddle chain (see list of definitions) and are transported in the direction of the stop. Between the stitching machine and the delivery system (see list of definitions) before reaching the stop, the carriers, which are integrated into the saddle chain and which act on the trailing edge of the folded sheets and ensure the targeted transport of the folded sheets in operative connection with the saddle chain, fold rearward so that they can then slide further under the folded sheet through the continued travel of the saddle chain.

As a result, during its final transport phase, the printed product thus formed is no longer carried along by the carrier but can be transported further to the stop solely by the friction induced by the saddle-shaped saddle chain or the residual force. It is also important in this case that the printed product opens wide as a result of the triggered kinematics in this final phase, i.e. between the stitching machine and the delivery system, so that the folded carrier can easily move through under it, especially in those cases, in which the printed product should be delayed during the delivery operation.

Regarding the stop: Initially, operation is carried out with an automatically adjustable stop. This stop is positioned accordingly with an electric motor (typically a servomotor) horizontally and preferably parallelly to the transport direction. This position is defined by the control profiles implemented in the main controller, where such a position can also be correspondingly changed for each produced printed product of different design. Such a positioning of the stop is dependent on parameters which are transmitted continuously to the main controller, namely at least the following:

a) The format size of the folded sheets or of the printed product;

b) Machine speed(s); and c) Possible manually entered offsets.

Furthermore, sensors are preferably installed in the immediate vicinity of this stop, or even integrated therein, which sensors are capable of detecting a paper jam immediately and of triggering corresponding relieving measures, which also serve for machine protection. For this purpose, jam switches, camera systems, photocells, etc. are preferably installed. In addition, sensors, preferably in the form of photocells, camera systems, etc., are also provided that serve as feedback for the position control of the printed product.

This stop has multiple functions with respect to the end positioning of the folded sheet (or the booklet or generally of the printed product), namely that the stop applies a certain nominal fixed stop position relative to the transported printed product as a final location, although not exclusively in a conventional manner as a fixed stop station. That is, the printed product is not transported in the horizontal transport movement to the fixed wall of the stop in order to then be completely braked there, but this stop simultaneously performs the function of serving as an alignment aid for the front edge of the printed product against a canting or tilting thereof during the further dynamic transfer into the delivery system. The stop, with its specific design and in operative connection with the controlled transport of the printed product, thus fulfills a double function, which is characterized in the immediate area of the stop by horizontally/vertically superimposed movements of this printed product.

These superimposed movements are to be understood as follows: On the one hand, there is a horizontal movement of the printed product (folded sheet or booklet) predetermined by the saddle chain, the kinematic energy of which printed product is now not completely and abruptly destroyed by the stop, but instead the printed product is picked up and lifted away from the saddle chain by the locally acting means of the delivery system and of an ejector in operative connection therewith shortly before impinging on the stop.

During this time interval tending toward zero, the printed product further conveyed in the horizontal direction still has a minimized residual velocity in the horizontal direction, which causes a snug final abutting and subsequent sliding of the front edge of the ejected printed product along the wall of the stop. This adopted and also dynamically adjustable positioning of the stop in relation to the respective printed product produced is therefore also dependent on the speed.

This sliding along of the front edge of a folded sheet or of the booklet during the operative transfer of the printed product caused by the dynamics of the delivery system ensures that a canting of the same, which cannot be ruled out, does not happen so that the printed product has a perfect alignment with respect to the format during the subsequent cutting.

Thus, in the final phase of the positioning of the printed product, there is a matched control-guided interdependence between the horizontal movement of this printed product and its vertical transfer, wherein the stop then performs a double function, as already explained, namely on the one hand to ensure the end position of the printed product produced and on the other hand to prevent possible canting of the printed product during the vertical movement. The stop thus absorbs counter movements, which could lead to a tilting moment acting on the printed product, as a result of which the printed product could become oblique. These processes are in operative connection with a blade as part of an ejector arranged on the underside of the saddle chain, which components are discussed in greater detail below.

The sequence of a cycle is designed as follows:

a) When the job is set up, the stop is moved to the correct position depending on various parameters, such as format size, speed etc.;

b) Such a positioning of the stop can also be carried out continuously during the delivery; and c) During operation, the stop is monitored with sensors (such as photocells, camera systems, etc.) and readjusted if necessary "on-the-fly" (see list of definitions) via the controller.

The position-dependent setting of the stop and the continuous monitoring of the process are preferably carried out by stored control profiles, where the main controller is able to carry out a regulation according to adaptive principles. Furthermore, the main controller can also provide a predictive/anticipatory regulation which applies to all units of the system.

The advantages of such a stop include the following:

a) Through the separate drive (servomotor) of the stop in particular, perfect adjustment (see list of definitions) can be established for each printed product using on-the-fly operation;

b) The adopted operative position of the stop is substantially dependent on the format of the folded sheet or booklet produced and on the speed of the saddle chain. As mentioned above, this operative position adopted by the stop can be established in a controlled manner according to stored control profiles or continuously in a regulated manner;

c) From continuous feedback from sensors, such as photocells, camera systems, etc., the position of the stop can also be continuously adjusted in "on-the-fly" operation;

d) The stop absorbs counter movements of the printed product, which could lead to a tilting moment thereof, thus ensuring that the folded sheet, the booklet, or the printed product in general can assume a maximized format-dependent and targeted position during the delivery carried out by the delivery system;

e) The stop basically defines the horizontal end position of the product with respect to the delivery (also called ejection) initiated by the delivery system, wherein this position is always strictly oriented toward the fact that the delivery always ensures a central ejection with respect to the operating means of the delivery system, in this case preferably formed by conveyor belts, irrespectively of the format size (minimum/maximum format) of the folded sheet; and f) The stop is directly or indirectly additionally equipped with corresponding sensors, which are aimed at jam control, detect such at an early stage and can also counteract it by interposing regulating interventions, thus preventing damage to the system or sustainably reducing the time required for repairing the breakdown.

Regarding ejectors: A second unit relates to an ejector, which delivers the folded sheet/the brochure, and in general the printed product, according to the below-discussed criteria via a blade integrated there.

Phase I: First, the (preferably directly or indirectly) motor-driven blade remains below the delivery system in a neutral position ("zero position"). Here, as part of the ejector, the blade waits for the arrival of the "Trigger" command to trigger the movement kinematics. The ejector then starts its movement at the "Trigger" position in order to push the printed product into the delivery system as consistently as possible. This triggering point depends on the product format, on the speed of the saddle chain, and on a possible manual correction, insofar as a defined or continuously freely definable speed threshold is exceeded or undershot, which defines whether the subsequent phase II or III can be initiated.

Phase II: Above the speed threshold, the speed of the ejector depends on that of the saddle chain, or of the delivery system's conveyor belts of the delivery system. In other words, if the speed of the saddle chain is increased, the ejector (the blade) moves up correspondingly faster. If the speed of the saddle chain is reduced, the ejector moves correspondingly slower.

Phase III: The movement profile is constant below the speed threshold. A minimum speed of the ejector is thus defined in order to ensure the transfer of the printed product to the conveyor belts of the delivery system.

As regards the displacement movements of the ejector, the following positions are to be distinguished:

a) On the one hand, the ejector moves to a point referred to as "top position." This "top position" is the upper turning point of the blade; from here, the position "bottom position" is approached with a defined or continuously freely definable speed; and b) "Bottom position" is the lower turning point of the blade; from here, the position "zero position" is approached with a defined or continuously freely definable speed.

The blade as part of the ejector therefore takes three fixed positions, which either are positions defined in advance or are continuously freely defined. That is, the "top position" is the highest position of the blade and forms as it were its turning point, where the transfer of the folded sheet to the conveyor belts of the delivery system is completed. "Bottom position" is the lowest position of the blade as a turning point; therefore, the blade moves downward to this position in order to not collide with the following, produced printed product on the saddle chain. "Zero position" represents that neutral position from which the blade starts to function for a following printed product.

Advantages of the operation of blade and ejector described herein, include:

a) A dynamic, variable eject time is used;

b) The dynamically variable profile is continuously calculated by the main controller or entered by predetermined tables, these values being either supported by stored control profiles or algorithms for dynamic control/regulation;

c) A regulation, based on optical measurements, continuously intervenes, which directly leads to targeted corrections or predictive controls;

d) The ejection profile being also modifiable by "on-the-fly" dynamics;

e) The control/regulation of the entire process over all units involved takes place continuously by determining thicknesses and format of the printed sheets (folded sheets) and by the continuously detected speeds of the transport chain (saddle chain);

f) If required, a freely selectable profile being implemented which is operated completely independently of other parameters, such as saddle chain speed or delivery system conveyor belt speed;

g) Start/stop ramps are freely programmable, adaptively adaptable and adjustable; and h) The units of the system involved allow them to be reprogrammed to non-linear motion sequences.

Regarding the device adjustable based on the thickness of the printed product: According to the invention, the delivery system is expanded by means of a device that has a mechanism that also adjusts to the thickness of the printed product delivered in each cycle.

The starting point in this case is the detection of the thickness of the printed product supplied, i.e. of the printed product to be delivered. The controller is in this case configured such that this thickness can (potentially or actually) vary in each production cycle. Accordingly, those differences in thickness within a job that are relevant for the detection of the printed products by the delivery system are also continuously detected. A predetermined tolerance is taken into account by the controller. The thickness spectrum can advantageously be managed by an MIS (see list of definitions), wherein the thickness of the printed product per se can also be calculated by the number of folded sheets and their thickness.

If a direct thickness measurement of the printed product is carried out, it is advantageous if such a thickness measurement takes place before the stitching or is already ascertained there. The detection of the thickness of the printed product is therefore the original basis when it comes to a symmetrical detection of the respective measured thickness of the printed product with respect to the center of the saddle chain on the one hand, and with respect to the center of the blade belonging to the ejector on the other hand.

The main aspect according to an embodiment of the invention therefore involves the symmetrical alignment of the thickness of the printed product with respect to the center of the saddle chain on the one hand, and with respect to the center of the ejector blade belonging to the ejector on the other hand. This adjustment takes place continuously and is preferably accomplished by an electric motor, typically a servomotor, by means of which the symmetrical adjustment in relation to the measured thickness of the printed product takes place. This takes place in that two symmetrically mounted pivot arms each operate in combination on both sides of the infeed region of the delivery system, where each pair of pivot arms is brought into position in relation to the printed product to be detected via a double cam disk when the aim is to create a printed-product-related opening according to the measured thickness.

The cam disk is rotated by a specific angle via a toothed belt drive so that the cam disk assumes, through the new angular position, that opening which causes a certain opening dimension. The pivot arms arranged in pairs run parallelly to each other in the normal state in the vertical, and they have a bearing on the end opposite to the infeed region of the delivery system. This bearing is formed on abutting rollers such that a spreading for detecting the thickness of the delivered printed product at an angle from the top downward results (i.e. these rollers belonging to the two pivot arms perform the function of a hinge point). These rollers rotate against each other by a certain angle in a stationary manner during spreading. The spreading for detecting the thickness of the printed product delivered can also be achieved in such a way that the pivot arms operating in pairs being now open parallelly to one another. This presupposes, for reasons of stability, that both ends of the pivot arms are preferably braced with one spring element each.

The set opening of the pivot arms relative to one another, which are supplemented by the integrated infeed rollers on the printed product side, is predetermined by a corresponding rotation of said cam disk. These pivot arms assume a stabilized position in that, at the end in the region of the infeed rollers is arranged a spring, the force of which also acts on the cam disk. It is thus established that the respective printed-product-related opening of the pivot arms is stabilized such that the opening of the pivot arms forms the free distance between the swivel rollers, which corresponds closely with the measured thickness of the printed product, wherein it is precisely this close setting that produces a force-fit effect, implemented by the spring force, on the detected printed product after ejection from the ejector. In this case, it must be taken into consideration that this narrow, free width between the infeed rollers operating also in combination across the entire infeed region of the delivery system in relation to the effective thickness of the respective printed product may not result in a potential excessive traction during the pick-up of the printed product since otherwise even the flowing pick up of the printed product by the infeed rollers during the ejection process from the ejector could be endangered.

A further kinematics according to the invention in the pick-up of the printed product by said infeed rollers consists in the fact that the pivot arms being spread over the effective thickness of the printed product in each cycle, and the frictional force on the printed product is then exerted by the spring, the path of which is limited by the assumed position of the cam disk. This means that the printed product from the ejection process being no longer picked up by overcoming a close setting with regard to the free width of the infeed rollers to each other but the pick-up is rather achieved by a laterally applied spring force.

It is preferable to dispense with a closed cam disk so that the pivot arms could nevertheless deflect during a jam, for example. Furthermore, the system is to be equipped with optical sensors, such as photocells, camera systems, etc., so that the position of the printed product in the conveyor belts of the delivery system can be detected at any time and tracked and evaluated on its way to the downstream cutting apparatus. This makes constantly correcting the position of the infeed rollers possible. The adjustment as such and its degree can in principle be carried out in "on-the-fly" mode, wherein only the speed of the saddle chain could then be limiting.

Job data from the MIS (see list of definitions) or from a separate job data system include: the format data of the individual folded sheets as well as format data of the printed product, such as cut width and length, as well as extensively all other data mandatory or situationally necessary for a particular job. As already mentioned, the controller can also calculate the thickness of the respective printed product from the data of the individual folded sheets. The main controller is also loaded with those algorithms with which all production-relevant values of the system being be determined. In particular, this main controller is able to calculate the values which are used for controlling the free width of the infeed rollers to each other; this is preferably done by a servomotor which acts mechanically on the cam disk(s).

Accordingly, job data from an MIS (see list of definitions) or from a separate data system preferably lead to the activation of stored control profiles, which in particular record the format data of the individual folded sheets, those of the booklet, such as cut width and length, and further data which are required for the qualitative implementation of the job. Preferably, the main control also contains algorithms which continuously calculate the thickness of the booklets from the production of the individual folded sheets.

When a new job is set up and during subsequent operation, the infeed of the delivery system, specified by the infeed rollers, is set to the correct free width in each product cycle depending on the thickness of the printed product. The setting position of the infeed rollers belonging to the delivery system being monitored by sensors, such as photocells, camera systems or similar systems, and readjusted via the controller in the event of deviations in "on-the-fly" mode. If a jam is detected, the infeed rollers open as wide as possible. If the monitoring determines that double removal has taken place, the infeed rollers open moderately in order to make up for these differences in thickness. If the printed product has differences in thickness from one part of the printed product to the other part of the printed product in comparison to the folding symmetry, the infeed rollers likewise open appropriately to handle this new starting situation. If an incomplete printed product is detected, the infeed of the infeed rollers is adjusted according to the value measured by the thickness control. If an incomplete printed product is detected and there is no thickness measurement, but the controller is connected to an MIS, the value being calculated on the basis of the values known from the MIS (thickness of the individual folded sheets) and the correct width of the infeed (printed product thickness) thus being set.

Advantages of the described device (including the infeed rollers with accessories) as a component of the delivery system can be seen in the fact that the combination of cam disk and the type of separate drive (step motor or servomotor) makes it possible for the adjustment to take place from one production cycle to the next, where the time-critical process must naturally be taken into account. The thickness setting is set symmetrically with respect to the saddle chain center. This symmetrical thickness adjustment takes place via two independently freely mounted pivot arms and a double cam disk. In case of incorrect removal of the folded sheets, the printed product thickness being determined by means of the thickness measuring device, or if the missing folded sheets are known, the thickness values being obtained from the MIS and the device being set in a cycle-precise manner with these values. Additional drives or pneumatic cylinders are not necessary as is the case in state of the art systems. In the event of jams, the infeed can also be fully opened without the need for additional drives or cylinders. Regarding the procedure in the case of asymmetrical thicknesses of the printed product, reference is made to the disclosure made above.

In summary, embodiments of the present invention relate to a system that is preferably designed as a saddle stitcher. This saddle stitcher substantially consists of a transport chain, which is of a roof-shaped design in the upper region. One or more printed products, preferably formed by folded sheets, are transported along this transport chain, collected, and optionally stitched in an intermediate stitching station, wherein a stop which being adjusted in accordance with the format of the printed product is arranged in the transport direction of the printed product after the optionally operating stitching station along the further course of the transport chain. A cyclic and format-stabilized delivery of the printed product is achieved by the stop in operative connection with interdependent operating means. The first means for the cyclic transfer during the delivery of the printed product consisting of one or more folded sheets consists of a delivery system. The delivery system has in its infeed region a device arranged to first transfer the printed product delivered, which device being adjusted to the respective measured thickness of this printed product.

On both sides of the infeed of the delivery system, the device itself respectively has two symmetrically mounted pivot arms which are spaced apart from one another and operate in pairs. The paired spacing of the pivot arms relative to one another is effected by an intermediately double cam disk, which implements a spreading of the pivot arms as a function of the respectively measured thickness of the delivered printed product by means of a rotating movement. The substantially horizontally extending pivot arms are provided at the ends in combination with one another over the entire region of the infeed of the delivery system with inlet rollers, which bring about the detection and further transport of the printed product delivered. The operating infeed rollers are also operatively connected via the pivot arms to a spring element, by means of which the infeed rollers are braced relatively to one another within the framework of the spreading predetermined by the cam disk as a function of the respectively measured thickness of the printed product delivered. This spreading of the pivot arms thus depends on the thickness of the printed product delivered. The infeed rollers exert a frictional force on the printed product by means of the spring element.

The spreading for detecting the thickness of the delivered printed product takes place through an angular opening from the top downward (i.e. the two rollers belonging to the pivot arms act as the hinge point and, during the spreading, rotate against each other by a certain angle in a stationary manner). The spreading for detecting the thickness of the delivered printed product is also achieved such that the pivot arms operating in pairs being also open parallelly to one another. This presupposes, for reasons of stability, that both ends of the pivot arms are preferably braced with one spring element each.

The device itself is equipped with a unit, which optionally makes a lateral adjustment of the device depending on the respective thicknesses of the printed product delivered in order to achieve an adjusting positioning of the device with respect to the thickness symmetry of the printed product delivered. This matching adjustment is only carried out when required, and it is also controlled according to the cycle, preferably during the kinematics of the pivot arms for establishing the thickness of the printed product.

The second means for the cyclic delivery of the printed product consisting of one or more folded sheets consists of an ejector, whereby the then format-stabilized printed product is preferably fed to a cutting apparatus via the further course of the delivery system after its infeed. During this delivery of the printed product, there is a change in direction relative to the transport direction of the transport chain by or by approximately 90°.

The adjustable stop has a stop plane, which is directed toward the transport direction of the transport section. The stop performs a coordinated stop and alignment function with respect to the front edge of the printed product consisting of one or more folded sheets during its delivery. The saddle chain is equipped with foldable transport fingers for co-transporting the printed product consisting of one or more folded sheets in order to prevent transport-related collisions.

The delivery system has a series conveyor belts that act in a coordinate manner and are operatively connected to an ejector arranged on the underside of the ridge of the printed product, and which cause this printed product to be delivered. The ejector is equipped with a projecting blade by means of which the printed product is conveyed from below into the delivery system.

The interdependent operation at least of the transport chain, stop, delivery system, ejector, cutting apparatus, is controlled by a main controller, wherein the interdependent operation at least of said units of the system is operated by stored control profiles and/or by an adaptive and/or predictive control, and wherein the main controller is operatively connected to at least one management information system (MIS).

The processes for the thickness-dependent pick-up of the printed product being delivered proceed as follows:

a) Depending on the measured thickness of the printed product being delivered, the device optionally performs a lateral adjustment to such an extent that the device now assumes a position in relation to the thickness symmetry of the printed product being delivered;

b) Depending on the measured thickness of the printed product being delivered, the pivot arms are spread against one another in pairs by an adjustment of the associated double cam disk to such an extent that the new free distance between the infeed rollers arranged at the ends of the pivot arms corresponds to the thickness of the printed product being delivered;

c) This position of the infeed rollers relative to one another, predetermined by the double cam disk, is stabilized in a force-fit manner by a spring element in that the spring element indirectly exerts a force on the double cam disk; and d) When transferring the printed product being delivered, the infeed rollers exert a frictional force due to the position of the double cam disk in relation to the pivot arms, which is increased by overcoming the spring force on the printed product being delivered.

The processes for the thickness-dependent pick-up of the printed product being delivered proceed as follows:

a) Depending on the respectively measured thickness of the printed product being delivered, the device optionally performs a lateral adjustment to the extent that the device now assumes a position in relation to the thickness symmetry of the printed product being delivered as required;

b) Depending on the determined thickness of the printed product being delivered, the pivot arms are spread against each other in pairs by an adjustment of the associated double cam disk to such an extent that the new free distance between the infeed rollers arranged at the ends of the pivot arms corresponds to the thickness of the printed product being delivered;

c) This position of the infeed rollers relative to one another, predetermined by the double cam disk, is stabilized in a force-fit manner by a spring element in that the spring element indirectly exerts a force on the double cam disk;

d) The infeed rollers exert a frictional force caused by the position of the double cam disk relative to the pivot arms when the printed product being delivered is transferred; and e) After each cycle, the pivot arms, and with them also the infeed rollers, open in order to go to the preceding or to a new position for the next printed product being delivered, depending on the measured thickness of the printed product being delivered.

The operative connection between stop and delivery system is characterized by the following criteria:

a) By means of a separate drive, the stop being positioned individually in the transport direction for each printed product in relation to its end position;

b) The assumed end position of the stop is at least dependent on the format of the printed product produced and taking into account the speed of the transport chain;

c) The stop defines the horizontal end position of the printed product with regard to the delivery initiated by the delivery system's operative means, wherein the assumed end position of the stop is set such that the printed product assumes a central position relative to the arrangement of the delivery system's means independently of its format size during delivery, wherein the delivery system's means consist of conveyor belts (131) which at the beginning capture the printed product on the folding side and transport it further in conformity with its format.

d) The operative end position of the stop to be taken is controlled at least by stored control profiles or is continuously controlled by sensors, such as photocells, camera systems; and e) The front wall of the stop, which is related to the printed product, has a stabilizing effect against a tilting moment and/or an inclined position of the printed product during the delivery, which is carried out by the delivery system's operative means.

The stop is coupled to a separate drive, wherein the stop ensures a precisely accurate positioning for each printed product by means of an "on-the-fly" operation. The stop is directly or indirectly equipped with corresponding sensors which respond to a jam control in the flow of the printed products produced, and such information is then forwarded to the main controller.

The operational process sequences of the ejector for delivering the printed product are carried out according to the following criteria:

a) A blade as a component of an ejector arranged below the delivery system and preferably equipped with a separate drive remains in a neutral position ("zero position") until arrival of a command which is transmitted by the main controller and initiates the triggering ("Trigger") of the delivery;

b) The ejector starts the movement of its operative parts of this "Trigger" position in order to consistently transfer the printed product into the delivery system, wherein this triggering is time-dependent on the speed of the transport chain, the format of the printed product, and any manual correction, and wherein the speed of the transport chain has a defined or continuously freely definable speed threshold;

c) Above the speed threshold, the speed of the ejector is oriented toward that of the transport chain and/or that of the conveyor belts belonging to the delivery system in such a way that, as the speed of the transport chain increases, the vertical movement of the ejector upward increases, and wherein the vertical movement of the ejector upward decreases correspondingly when the speed of the transport chain is reduced;

d) Below the speed threshold, the movement profile of the ejector is uniformly defined by a minimum speed in order to ensure the transfer of the printed product to the delivery system's conveyor belts.

The blade belonging to the ejector moves to an upper turning point (top position) when the printed product is delivered, while the blade moves to a lower turning point (bottom position) after completion of the delivery of the printed product, and finally the blade moves to a lower turning point (bottom position) after completion of the delivery of the printed product. From a lower turning point (bottom position), the blade then takes a neutral position (zero position).

The invention is described below with reference to the drawings, which show example embodiments sufficient to show features of the present invention.

FIG. 1 shows an overall view of a saddle stitcher 100. Substantially, such a saddle stitcher consists of a centrally operating saddle chain 110 which takes over the transport of the folded sheets 200 or of the booklet 600. Such a saddle chain 110 has a guide device with an upper section which is designed to be pointed, i.e. roof-shaped, and the ridge line of which defines the transport and stitching line on which the folded sheets 200 are transported astride. The individual folded sheets are assembled to a booklet in a stitching machine 120. The folded sheets rest on the saddle-shaped saddle chain and are transported therefrom toward the stop 160. Between the stitching machine 120 and a downstream delivery system 130, before reaching the stop 160, the carriers, which are integrated into the saddle chain and which act on the trailing edge of the folded sheets and ensure the targeted transport of the folded sheets in operative connection with the saddle chain, fold rearward so that they can then slide under the folded sheet with the continued movement of the saddle chain.

As a result, in the final transport phase, the printed sheets assembled to a booklet are no longer directly affected by the carrier but are transported further to the stop solely by the friction induced by the saddle-shaped saddle chain, or the residual force. Important in this case is also the triggered kinematics on the individual folded sheets or generally on the booklet in this final phase, namely to the effect that the printed product opens between the stitching machine and the delivery system so that the folded carrier can pass underneath the printed product without any problem. This is also particularly important in those cases when this printed product should be decelerated during the ejector operation.

The stitching machine itself, has a staple consisting of wire, wherein the wire is bent in a first step into a downward U shape, which is perfectly suitable for being pushed through the booklet and subsequently bent. This process is accomplished by at least one stitching head that cuts and positions the staple wire and forms it into a staple. The stitching process itself involves pushing at least one staple through the booklet and closing it at the other end. Part of the stitching machine is also a stitching carriage on which the stitching head is mounted, wherein the printed product is stitched inside this stitching station by means of the already mentioned staple while the stitching carriage moves.

The stop 160 with its predetermined stop plane 170 forms the end position of the transport on the saddle chain for folding sheets 200 or booklet 600 before said printed product is transferred to the delivery system 130 and is then transferred from here via a product feed 140 to a cutting apparatus 150. This cutting apparatus 150 functions as a cutting system that preferably has a front blade and two side blades and performs the cutting process consisting of a front cut and a head-foot cut as a subsequent cut.

The stop 160, preferably operated by a servomotor 161, fulfills multiple functions with respect to the end positioning of the booklet 600, namely that this stop itself applies a fixed stop position relative to the transported booklet in the last end state but not exclusively in a conventional manner as a fixed stop station. This means that the booklet is not transported in a horizontal transport movement to the front wall of the stop in order to be completely braked there, as is the case according to the state of the art, but that this stop simultaneously fulfills the function of serving as an alignment aid for the front edge of the booklet in the transport direction against a canting or tilting thereof during the further dynamic transfer of the booklet into the delivery system. By virtue of its specific design and in operative connection with the controlled transport of the booklet, the stop thus fulfills a double function which is characterized by superimposed horizontal/vertical movements of the booklet in the region of the stop.

These superimposed movements are to be understood as follows: On the one hand, there is a horizontal movement of the booklet, which is determined by the saddle chain, whose kinematic energy is now not completely and abruptly destroyed by the stop, but rather the booklet is ejected from the saddle chain by the ejector and picked up by the locally acting means of the delivery system infinitesimally shortly before impinging on the stop.

During this time interval tending toward zero, the booklet conveyed in the horizontal direction still has a minimized residual speed, which causes a full, close abutting and subsequent sliding of the front edge of the booklet along the wall of the stop. Therefore, this adopted and also dynamically adjustable positioning of the stop in relation to the respective folded sheet produced is also dependent on speed.

This vertically sliding movement of the front edge of the booklet along the wall of the stop during the transfer of the booklet into the delivery system ensures that there is no risk of the booklet being canted so that the booklet is perfectly aligned with respect to the format during the subsequent cutting process.

Thus, in the final phase during the positioning of the booklet, there is a coordinated controller-guided interdependence between the horizontal transport movement of the booklet and its vertical transfer, with the stop performing, as already explained, the dual function of, on the one hand, ensuring the end position of the booklet and, on the other hand, preventing it from canting during its vertical delivery. Accordingly, the stop also absorbs those counter movements which could lead to a tilting moment of the brochure so that it can no longer be tilted. These processes are in operative connection with a blade as part of an ejector arranged on the underside of the saddle chain, which is discussed in greater detail below.

Figure 2:
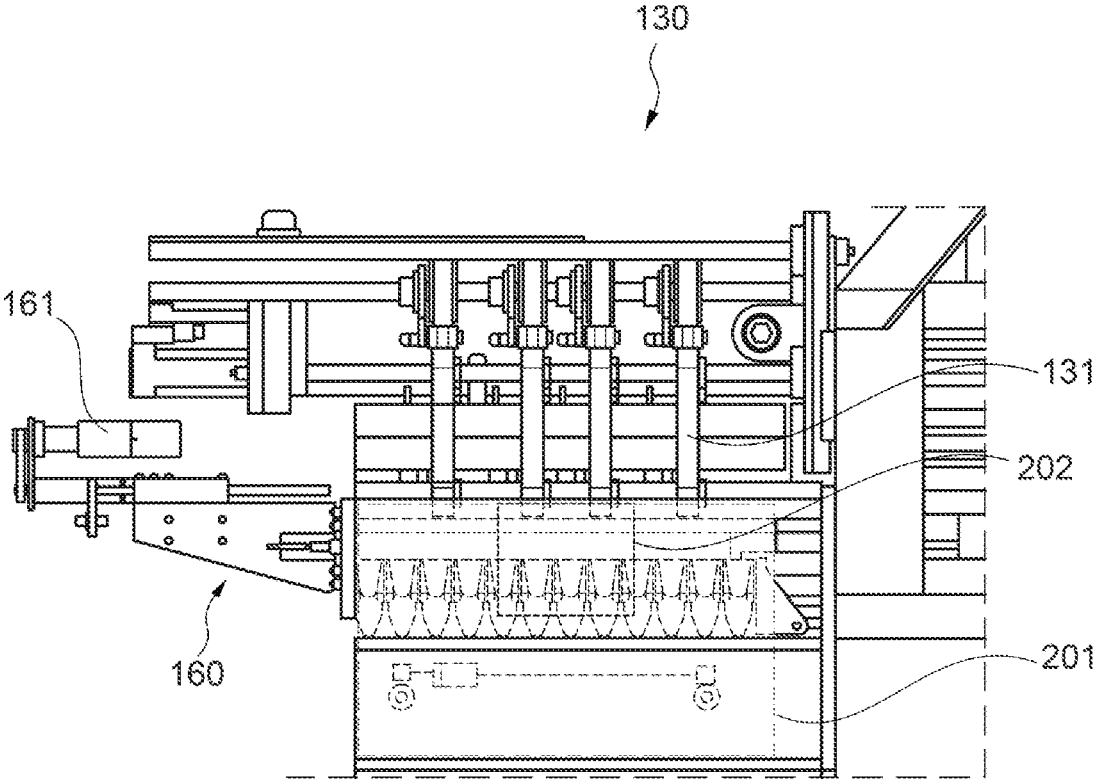
FIG. 2 shows an overall view of a delivery system with a driven stop.

FIG. 2 shows the delivery system 130 in operative connection with the motor-driven 161 stop 160 already explained. This delivery system is designed as a machine component which transports the folded sheet, the booklet or generally the printed products after the stitching station into the product feed (see FIG. 1, item 140) to the cutting apparatus (see FIG. 1, item 150). In the delivery system itself, a transport direction change by preferably 90° takes place via the conveyor belts 131 depending on the location of the cutting apparatus. The operating stop 160 basically defines the horizontal end position of the booklet with regard to the delivery implemented by the delivery system, wherein the delivery system is in operative connection with an ejector (see FIG. 4), wherein this position is always strictly directed to the fact that, irrespective of the small format size 202 or the large format size 201 of the booklet, the delivery always ensures a central ejection relative to the operating means of the delivery system, i.e. of the conveyor belts 131 arranged side by side.

Figure 3:
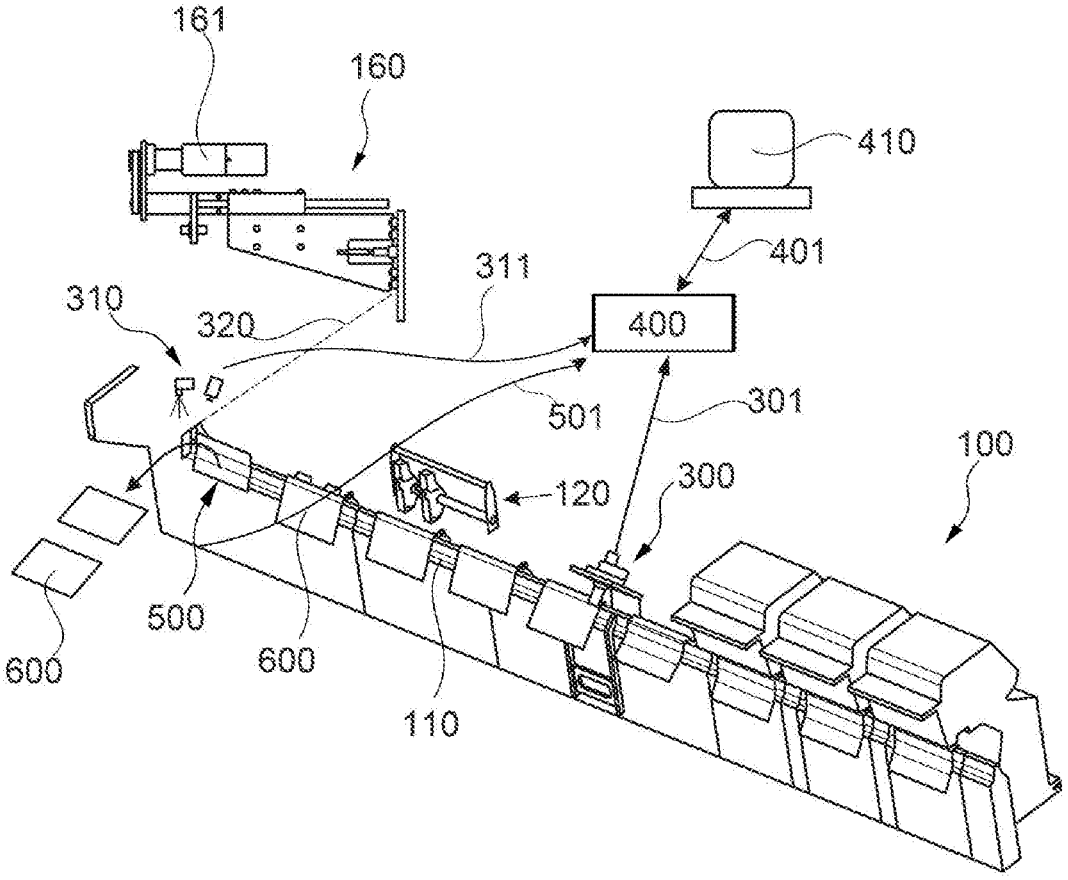
FIG. 3 shows an overall view of a saddle stitcher, with control/regulation functions, highlighting the stop.

FIG. 3 shows essentially the same saddle stitcher as in FIG. 1. This system is supplemented with essential control systems, the data of which is transmitted to a central controller 400 which in turn communicates bidirectionally 401 with an MIS system 410. This controller processes all incoming data from all units involved in the processing of the printed products, including the speed of the saddle chain 110, and then provides the targeted control of all units, especially with regard to the operation of the transport chain, stop, delivery system, ejector, depending on the format size of the respective printed product. The flows shown here in the collection of the operational data for the controller 400 are not to be understood as numerus clausus. First, it is an optical control system 310 in the region of the stop plane 320 of the stop 160 which passes the obtained information 311 to the controller 400.

Thereafter, the ejector 500 is continuously queried, the information 501 of which is also forwarded to the controller 400. Furthermore, the continuous thickness measurement 301 of the folded sheets is performed by device 300. Further acquisition of the operational data can, for example, be carried out for the stitching machine 120. In addition, the controller 400 is operatively connected in a bidirectional data flow system 401 to a management information system (MIS) 410, which system 410 has become known in the printing industry in connection with the term "Industry 4.0" under designations such as "Finishing 4.0," "Print 4.0" or "Web to Print". In principle, this refers to the digital transformation of the IT sector and production technology. In order to achieve these objects, the MIS system 410 is used in particular.

From these collected data and the continuous monitoring of the process, the positional setting and operation of units involved in the process of the saddle stitcher is ensured. As such, the integral regulation may be maintained by stored control profiles. The main controller is also capable of implementing a regulation according to adaptive principles; furthermore, the main controller is also capable of providing a predictive/anticipatory regulation.

Figure 4:
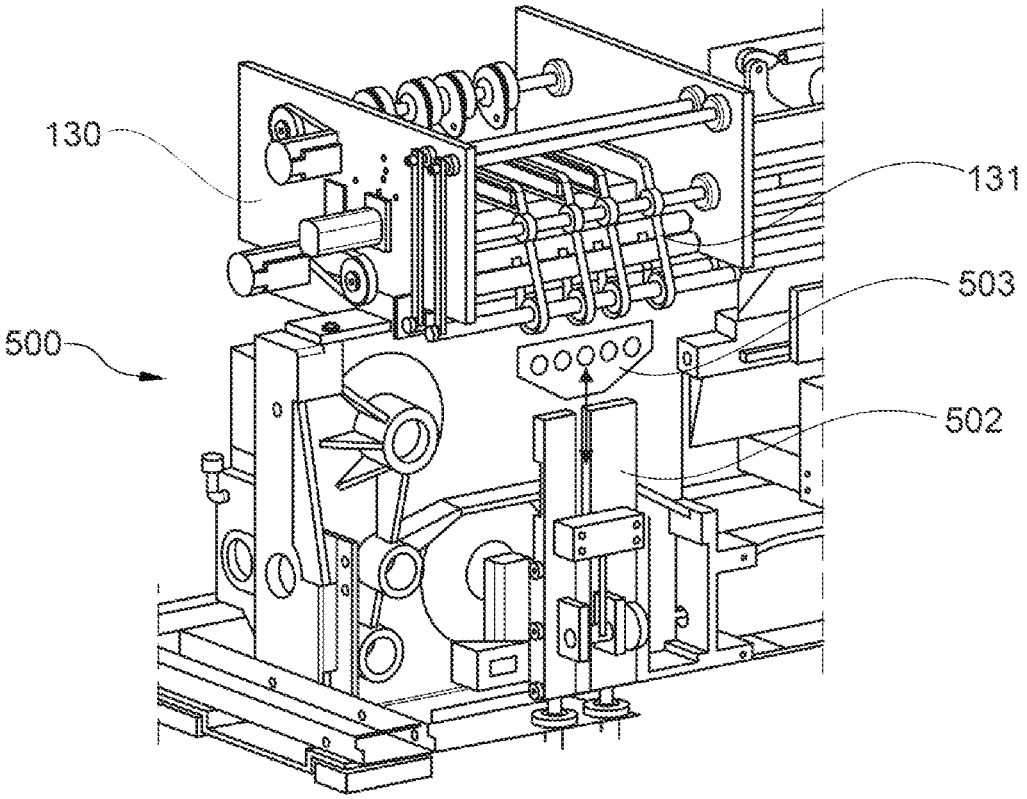
FIG. 4 shows an ejector operatively connected to a delivery system.

FIG. 4 shows an ejector 500 which is operatively connected to the delivery system 130 already described. The operation of this ejector 500 is as follows:

First, a blade 503 remains in a neutral position ("zero position") below the delivery system 130. The blade 503, which is coupled to an ejector tappet 502 and forms the components of the ejector in front, waits here. The ejector tappet 502 preferably has a separate drive, and upon arrival of the "Trigger" command, the triggering of the movement kinematics is started. When viewed as an overall unit, the ejector 500 then starts its movement at the trigger position in order to generally transfer the printed product as uniformly as possible into the delivery system. This "trigger" point is mainly dependent on the speed of the saddle chain, the product format and any manual correction such that the subsequent phases are initiated depending on whether a defined or continuously freely definable speed threshold is exceeded or undershot.

Above the speed threshold, the speed of the operative parts 502, 503 of the ejector 500 is oriented toward those of the saddle chain or of the delivery system's conveyor belts. In other words, if the speed of the saddle chain is increased, the ejector moves upward correspondingly faster. If the speed of the saddle chain is reduced, the ejector moves correspondingly slower.

The movement profile is constant below the speed threshold. This defines a minimum speed of the ejector in order to in any case ensure the transfer of the folded sheet to the conveyor belts of the delivery system.

As regards the displacement movements of the ejector, the following positions are to be distinguished:

On the one hand, the ejector moves to a point referred to as "top position." This "top position" is the upper turning point of the blade 503; from here, the position "bottom position" is approached with a defined or continuously freely definable speed.

"Bottom position" is the lower turning point of the blade; from here, the position "zero position" is approached with a defined or continuously freely definable speed.

The blade 503, or the tappet 502, of the ejector 500 therefore takes three fixed positions, which are either predefined positions or freely defined continuously. That is, the "top position" is the highest position of the blade and forms as it were its turning point, where the transfer of the folded sheet to the conveyor belts of the delivery system is completed. The "bottom position" is the lowest position of the blade as a turning point; the blade thus descends to this position in order to not collide with the following produced folded sheet on the saddle chain. The "zero position" represents that neutral position from which the blade starts to function for a following folded sheet.

Figure 5:
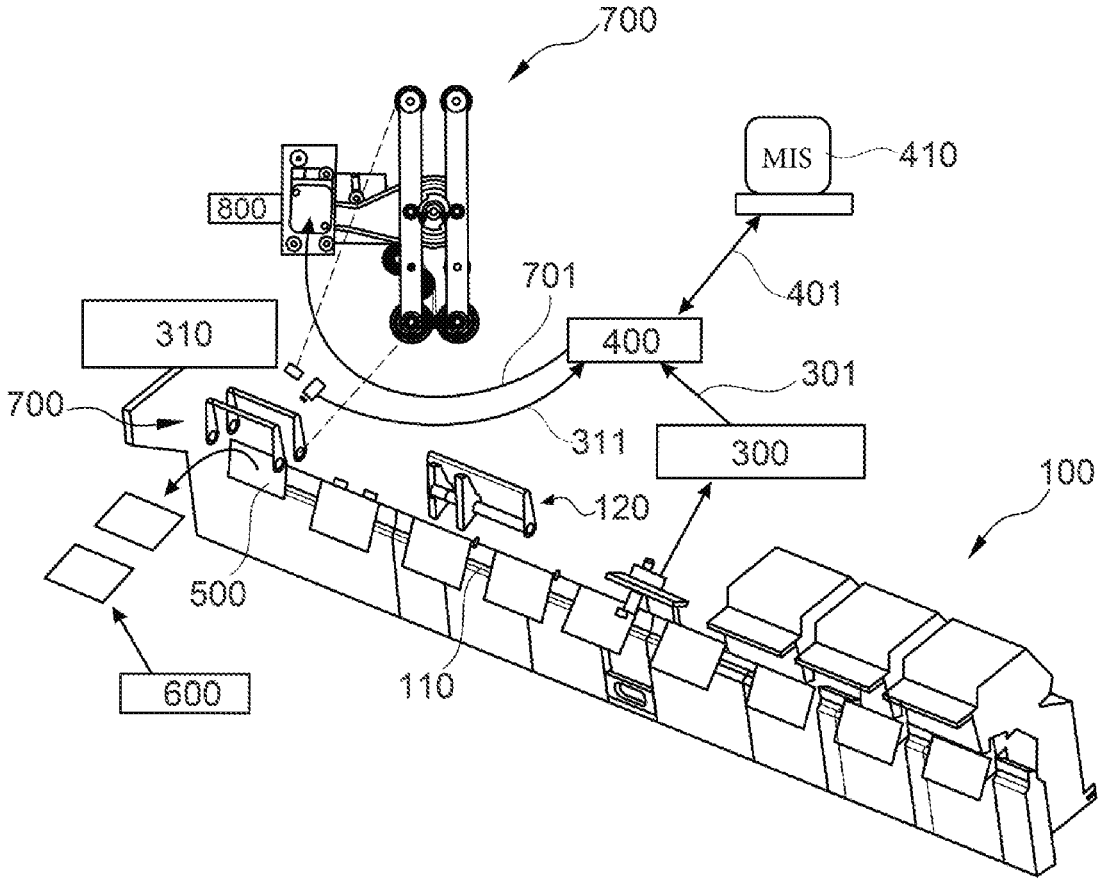
FIG. 5 shows an overall view of a saddle stitcher, with control/regulation functions, highlighting a controllable device according to the thickness of the printed product.

FIG. 5 shows essentially the same elements as in FIG. 1, highlighting the inventive development by a device (printed product transporter) 700 adjustable based on the thicknesses of the printed products being delivered, which device is driven by a motor 800 which acts in a data-connected manner 701 with the main controller 400. Otherwise, the explanations under FIG. 3 apply.

Figure 6:
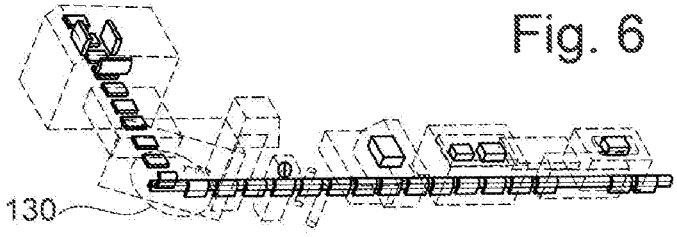
FIG. 6 shows an overall view of a saddle stitcher, highlighting the delivery system.

FIG. 6 shows essentially FIG. 1, wherein FIG. 6 shows the position of the delivery system 130 which contains the device 700 according to the invention.

Figure 7:
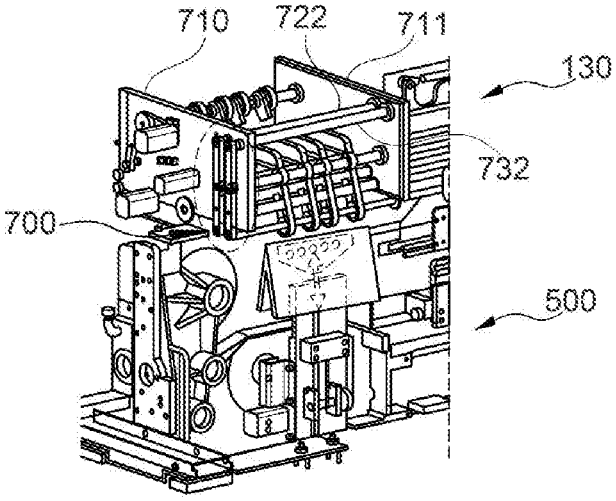
FIG. 7 shows a delivery system and ejector assembled, including the device.

FIG. 7 shows the assembled delivery system 130 and ejector 500 which operatively interact with each other. More details of the configuration of the delivery system are given in FIG. 2 and its description, while the construction of the ejector 500 is illustrated in FIG. 4 and its description. This FIG. 6 also shows that the delivery system 130 is supported by lateral plates 710, 711, which are used to support the transverse shafts 722, 732. These transverse shafts span the entire infeed region of the delivery system. Further details are given in FIG. 8.

Figure 9:
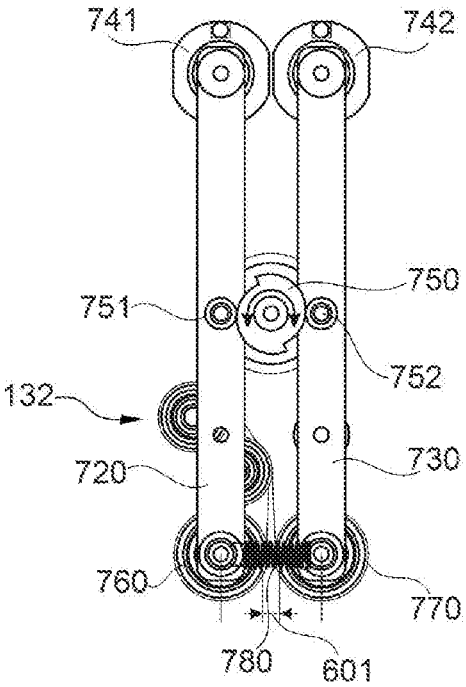
FIG. 9 shows operation of the pivot arms.
Figure 8:
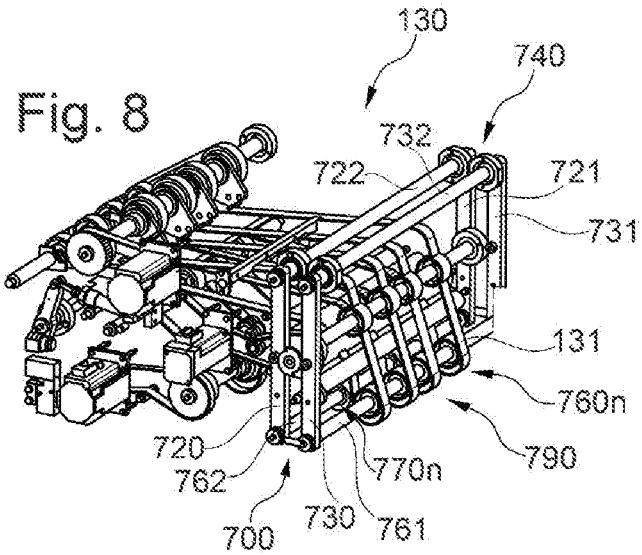
FIG. 8 shows delivery system with the components of the device.
Figure 10:
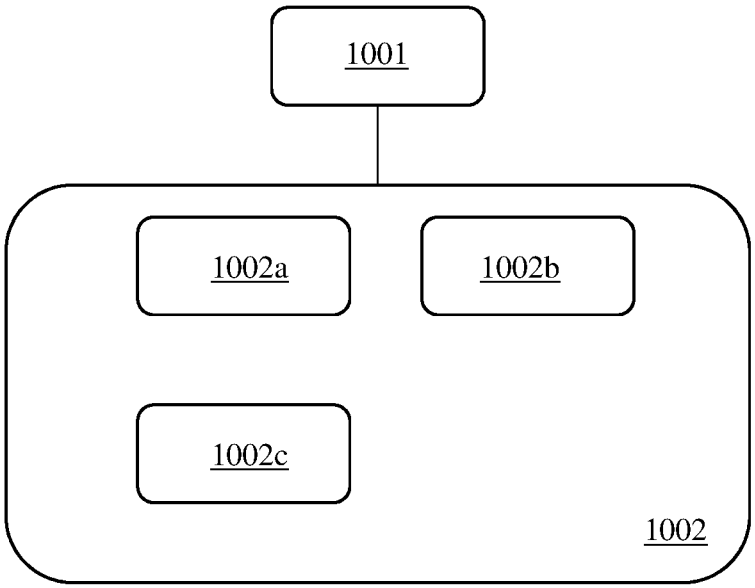
FIG. 10 shows a method for operating a system according to an embodiment of the present invention.

FIGS. 8 and 9 show the effective construction of the device 700. The starting point in this case is the detection of the thickness (601) of the printed product being delivered. The controller (see FIG. 5) is in this case set up such that this thickness can potentially or actually vary for each production cycle. Accordingly, those differences in thickness within a job that are relevant for the detection of the printed products by the delivery system 130 are also continuously detected. A predetermined tolerance is taken into account by the controller. The thickness spectrum can advantageously be managed by an MIS (see list of definitions), wherein the thickness of the printed product per se can also be calculated by the number of folded sheets and their thickness.

On each side of the infeed region 790 of the delivery system 130, this device 700 has two symmetrically mounted pivot arms 720, 730; 721, 731, which are spaced apart from each other and operate in pairs, wherein the paired spacing of the pivot arms relative to each other is effected by an intermediately arranged double cam disk 750, which implements a spreading of the pivot arms as a function of the respectively measured thickness (601) of the printed product delivered. The substantially horizontally extending pivot arms in combination with each other carry infeed rollers 760*n*, 770*n* at the end over the entire infeed region 790 of the delivery system 130, which rollers bring about the detection and further transport of the printed product delivered, regardless of its format size. The operating infeed rollers 760*n*, 770*n* thus cover the entire infeed region of the delivery system and are each mounted on a connecting shaft 761, 762 between opposite pivot arms, namely 720 to 721 and 730 to 731, so that the infeed rollers are also indirectly in operative connection with a spring element 780 placed at the end of the pivot arms, in such a way that the infeed rollers have a predetermined spring-loaded spreading with respect to one another within the frame of the through the cam disk 750 depending on the respectively measured thickness of the printed product delivered, and a frictional force is thus exerted on the printed product being delivered.

This spreading of the pivot arms 720, 730; 721, 731 occurs on both sides of the operative infeed region of the delivery system 130, in each case depending on the thickness of the printed product delivered, wherein the infeed rollers 760*n*, 770*n* exert a frictional force on the printed product by virtue of their operative connection with the spring element 780. FIG. 9 shows a pair of pivot arms on one side of the delivery system, wherein schematically further rollers and associated conveyor belts 132 of the delivery system 130 are depicted, which together ensure the further transport of the printed product. The individual infeed rollers 760, 770 are shown here.

The spreading for detecting the thickness of the delivered printed product takes place angularly from the top downward, i.e. the two rollers 741, 742 belonging to the pivot arms 720, 730 act as the hinge point 740 and, during the spreading, rotate against each other by a certain angle in a stationary manner. The spreading for detecting the thickness of the printed product delivered is also achieved in such a way that the pivot arms operating in pairs can also open parallelly to one another. With reference to the double cam disk 750 shown there, FIG. 9 shows which bracing procedure is preferably used here: Each pivot arm 720, 730 carries a resistance bolt 751, 752 on each side, preferably in the plane of symmetry of the cam disk, which resistance bolts cause a force-supported spreading of the pivot arms by the rotation of the cam disk along its profile.

An embodiment of the present invention includes a method 1000 for operating a system. The method includes transporting a printed product in a horizontal transport direction to a fixed wall of a stop 1001, and simultaneously performing, using the stop, a stopping and an aligning function on the printed product 1002, which aligns the front edge of the printed product against a canting or tilting thereof during the transfer into the delivery system. The simultaneous performance of the stopping operation and the aligning operation 1002 comprises: a horizontally and vertically superimposed movements of the printed product 1002*a*, the horizontal movement of the printed product being predetermined by the operation of the saddle chain, where the stop does not completely and abruptly stop the horizontal movement of the printed product 1002*b*, and where the printed product is lifted away from the saddle chain by the delivery system in operative connection with the ejector prior to impinging on the stop 1002*c*.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

below is a list of reference numbers used herein:

100 System, saddle stitcher
110 Saddle chain, transport chain
120 Stitching
130 Delivery system
131 Conveyor belts, means
132 Further course of the delivery system for further transport of the printed product in general
140 Product feed to the cutting apparatus
150 Cutting apparatus
160 Stop, overall structure of the device
161 Motor, servomotor
170 Product-related stop plane
200 Folding sheet, booklet, printed product in general
201 Folding sheet, booklet, large format
202 Folding sheet, booklet, small format
300 Thickness measuring device
301 Data from the thickness measuring device for the controller
310 Control systems
311 Data from the control systems for controller
320 Stop plane of the stop
400 Controller, main controller
401 Data exchange control/MIS
410 MIS (management information systems)
500 Ejector, ejecting device
501 Data from the ejector for the controller
502 Ejector tappet
503 Blade
600 Booklet, printed product in general
601 Thickness of printed product
700 Device, adjustable
710 Lateral plate for the bearing of the transverse shaft and pivot arm
711 Lateral plate for the bearing of the transverse shaft and pivot arm
720 Pivot arm to the coordinate pivot arm 730
721 Pivot arm to the coordinate pivot arm 731
722 Transverse shaft
730 Pivot arm to the coordinate pivot arm 720
731 Pivot arm to the coordinate pivot arm 720
732 Transverse shaft
740 Hinge point in general
741 Roller
742 Roller
750 Cam disk
751 Resistance bolt against kinematics of cam disk
752 Resistance bolt against kinematics of cam disk
760 Individual infeed roller
**760*n*** Combination of infeed rollers along the infeed region of the delivery system
761 Connecting shaft for receiving the inlet rollers
762 Connecting shaft for receiving the inlet rollers
770 Individual infeed roller
**770*n*** Combination of infeed rollers along the infeed region of the delivery system
780 Spring element
790 Infeed region
800 Motor for operating device 700

The invention claimed is:

1. A system comprising:

a transport chain, which is roof-shaped in an upper region, along which one or more printed products are transportable astride, collectable, and optionally stitchable in an intermediate stitching station; and a stop, which is adjustable in accordance with a format of a printed product of the printed products being delivered, is arranged in a transport direction of the printed products, and is positioned after the intermediate stitching station along the transport chain, the stop corresponding to a location of delivery of the printed product from the transport chain, wherein a cyclic transfer of the printed product during the delivery takes place via a delivery system, the delivery system having in an infeed region a printed product transporter configured to transfer the printed product being delivered, the printed product transporter comprising pivot arms, the pivot arms being controllable according to a measured thickness of the printed product being delivered, and wherein the stop is adjustable and has a stop plane that is oriented toward the transport direction of the printed product, the printed product comprising one or more folded sheets, the stop being configured to perform a matched stop and alignment function with respect to a front edge of the printed product during its delivery, wherein the system is configured to perform the matched stop and alignment function such that: there are horizontally and vertically superimposed movements of the printed product, the horizontal movement of the printed product being predetermined by the operation of the saddle chain, the stop does not completely and abruptly stop the horizontal movement of the printed product, and the printed product is lifted away from the saddle chain by the delivery system in operative connection with the ejector prior to impinging on the stop.

2. The system according to claim 1, wherein the pivot arms of the printed product transporter are arranged in pairs and on both sides of the infeed region of the delivery system, wherein each of the pairs respectively comprises two of the pivot arms which extend essentially vertically and are spaced apart from one another, and wherein each of the pairs of the pivot arms is operatively connected to a double cam disk, the cam disk being configured to implement a spreading of the corresponding pivot arms by a rotary movement and at the same time a change in a distance between infeed rollers operatively connected to the pivot arms, depending on the measured thickness of the printed product being delivered.

3. The system according to claim 2, wherein the pivot arms in combination with one another operate over an entirety of the infeed region of the delivery system, and wherein the infeed rollers operate in a coordinate manner, are mounted on connecting shafts clamped between individual ones of the pivot arms, and are configured to bring about an integral detection and further transport of the printed product being delivered.

4. A system according to claim 2, wherein the spreading of the pivot arms takes place with the inclusion of the infeed rollers, which are arranged transversely to the infeed of the delivery system, for detecting the measured thickness of the printed product being delivered by an angular opening of the pivot arms from the top downward.

5. The system according to claim 2, wherein the pivot arms are operatively connected to a spring element in order to determine the measured thickness of the printed product being delivered with the inclusion of the infeed rollers arranged transversely to the infeed of the delivery system, and wherein, by the spring element, a spring force acts on the cam disc to effect a predetermined spreading of the pivot arms to each other, and, simultaneously with the pivot arms, the corresponding infeed rollers are subjected to the spring force.

6. The system according to claim 2, wherein the spreading of the pivot arms is a spring-loaded spreading, and is configured to take place with inclusion of the infeed rollers, which are arranged transversely to the infeed of the delivery system, depending on the respectively measured thickness of the printed product being delivered, and wherein a spring force for the spring-loaded spreading is exerted by a spring element, the spring force causing a frictional force of the infeed rollers to be exerted on the printed product delivered.

7. The system according to claim 2, wherein the spreading of the corresponding pivot arms is for detecting the thickness of the printed product being delivered, and is configured to take place in such a way that the pivot arms operating in pairs open parallelly to one another, with the inclusion of the infeed rollers arranged transversely to the infeed of the delivery system, and that each pair of pivot arms have a spring element therebetween which serves to clamp the ends of each pair of pivot arms to one another.

8. The system according to claim 2, wherein in the case of a jam of the printed product being delivered, the pivot arms with the inclusion of the infeed rollers arranged transversely to the infeed of the delivery system, are configured to open to a maximum or quasi-maximum, wherein in the event of a double removal of folded sheets, the pivot arms with the inclusion of the infeed rollers arranged transversely to the infeed of the delivery system, are configured to open according to thickness differences among the printed products, and wherein in the event that the printed product being delivered has a difference in thickness from one part of the printed product to another part of the printed product in comparison to a folding symmetry, open the pivot arms with the inclusion of the infeed rollers arranged transversely to the infeed of the delivery system.

9. The system according to claim 1, wherein the stop, in interactive connection with interdependently operable components, provides a cyclically and format- stabilized delivery of the printed product.

10. The system according to claim 1, wherein the printed product transporter is configured to make a lateral adjustment depending on the measured thickness of the printed product being delivered, and wherein the printed product transporter is configured to adjust position with respect to a thickness symmetry of the printed product being delivered.

11. The system according to claim 1, wherein an ejector is operatively connected to the delivery system, the ejector being configured to cyclically deliver the printed products, which each comprising one or more folded sheets.

12. The system according to claim 1, further comprising a cutting apparatus operatively arranged after the delivery system, the cutting apparatus configured to be fed the printed product after it has been format-stabilized via the stop.

13. The system according to claim 1, wherein the system is configured to change a direction of the printed product in a region of the delivery system, the change of the direction being in relation to the transport direction of the transport chain by approximately 90°.

14. The system according to claim 1, wherein the transport chain is a saddle chain that is equipped with foldable transport fingers for co-transporting the printed product, which comprises one or more folded sheets.

15. The system according to claim 1, wherein the delivery system has a series of conveyor belts that act in a coordinated manner, and that are operatively connected to an ejector arranged on the underside of the ridge of the printed product, the conveyor belts configured to effect further delivery of the printed product.

16. The system according to claim 15, wherein the ejector is equipped with a projecting blade by which the printed product is deliverable from below into the delivery system.

17. The system according to claim 1, wherein the system is a saddle stitcher.

18. A method for operating a system, the system comprising:

a transport chain, which is roof-shaped in an upper region, along which one or more printed products being transported astride, collected, and optionally stitched in an intermediate stitching station;

a stop, which is adjustable in accordance with a format of a printed product of the printed products being delivered, is arranged in a horizontal transport direction of the printed products, and is positioned after the intermediate stitching station along the transport chain, the stop corresponding to a location of delivery of the printed product from the transport chain; the stop having a fixed wall;

an ejector;

a cutting apparatus;

a delivery system; and a main controller, wherein a cyclic transfer of the printed product during the delivery takes place via the delivery system, the delivery system having in an infeed region a printed product transporter configured to transfer the printed product being delivered, the printed product transporter comprising pivot arms, the pivot arms being controllable according to a measured thickness of the printed product being delivered, the method comprising:

independently operating at least the transport chain, the stop, the delivery system, the ejector, and the cutting apparatus, the independent operation being controlled by the main controller, transporting the printed product in the horizontal transport direction to the fixed wall of the stop, and simultaneously performing, using the stop, a stopping function and an aligning function on the printed product, the aligning function aligning the front edge of the printed product against a canting or tilting thereof during the transfer into the delivery system, wherein the simultaneous performance of the stopping operation and the aligning operation comprises a horizontally and vertically superimposed movements of the printed product, the horizontal movement of the printed product being predetermined by the operation of the saddle chain, wherein the stop does not completely and abruptly stop the horizontal movement of the printed product, wherein the printed product is lifted away from the saddle chain by the delivery system in operative connection with the ejector prior to impinging on the stop.

19. The method according to claim 18, wherein the interdependent operation is done according to stored control profiles and/or by an adaptive and/or by predictive control.

20. The method according to claim 18, wherein the main controller is operatively connected to at least one management information system.

21. The method according to claim 18, the method comprising operating the printed product transporter according to processes with a thickness- dependent detection of the printed product, the processes comprising:

a) depending on the measured thickness of the printed product to be delivered, the printed product transporter performs a lateral adjustment to an extent that the printed product transporter now assumes a position in relation to a thickness symmetry of the printed product to be delivered;

b) depending on the measured thickness of the printed product to be delivered, the pivot arms are spread in pairs against one another by an adjustment of an associated double cam disk to such an extent that a new free distance between infeed rollers arranged at ends of the pivot arms corresponds to the measured thickness of the printed product to be delivered;

c) the position of the infeed rollers, which is predetermined by the double cam disk, is stabilized in a force-fit manner by a spring element, the spring element indirectly exerting a pressing force on the double cam disk; and d) the infeed rollers exert a frictional force on the printed product caused by a position of the double cam disk and in operative connection with the spring element when the printed product to be delivered is transferred.

22. The method according to claim 21, wherein the frictional force on the printed product to be delivered arises from the spring force resulting from the spring element.

23. The method according to claim 18, the method comprising operating the printed product transporter according to processes with a thickness- dependent detection of the printed product, the processes comprising:

a) depending on the measured thickness of the printed product to be delivered, the printed product transporter performs a lateral adjustment to such an extent that the device now assumes a position in relation to a thickness symmetry of the printed product to be delivered;

b) depending on the measured thickness of the printed product to be delivered, the pivot arms are spread in pairs against one another by an adjustment of an associated double cam disk to such an extent that a new free distance between infeed rollers arranged at ends of the pivot arms corresponds to the measured thickness of the printed product to be delivered;

c) the position of the infeed rollers relative to one another, predetermined by the double cam disk, is stabilized in a force-fit manner by a spring element, the spring element indirectly exerting a force on the double cam disk;

d) the infeed rollers exert a frictional force caused by a position of the double cam disk relative to the pivot arms when the printed product to be delivered is transferred; and e) after each cycle, the pivot arms, and with them the infeed rollers, open briefly over a predetermined or entire thickness of the printed product to be delivered, and thereafter the infeed rollers return to a preceding position or move to a new position during a new detection of a new printed product to be delivered, depending on the present thickness of the printed product to be delivered.

24. The method according to claim 23, wherein in the event of a detected jam of the printed products conveyed, the pivot arms are opened to a maximum or quasi-maximum, with an inclusion of infeed rollers arranged transversely to the infeed of the delivery system, wherein in the event of a double removal of folded sheets, the pivot arms open with the inclusion of the infeed rollers arranged transversely to the infeed of the delivery system in accordance with thickness differences of the printed products, and wherein in the event that the printed product being delivered has a difference in thickness from one part of the printed product to another part of the printed product in comparison to a folding symmetry, open the pivot arms with the inclusion of the infeed rollers arranged transversely to the infeed of the delivery system.

25. The method according to claim 18, wherein an operative connection between the stop and the delivery system is achieved according to:

a) by a separate drive, the stop is positioned individually in the transport direction for each printed product in relation to its end position;

b) an assumed end position of the stop is at least dependent on a format of the printed product produced and by taking into account a speed of the transport chain;

c) the stop defines a horizontal end position of the printed product with respect to the delivery initiated by at least one conveyor of the delivery system, wherein the end position assumed by the stop is adjusted in such a way that the printed product assumes a central position relative to an arrangement of the conveyor of the delivery system during the delivery regardless of a format size of the printed product;

d) an operative end position of the stop to be taken is controlled by stored control profiles or is continuously controlled by sensors; and e) a front wall of the stop, which is related to the printed product, has a stabilizing effect against a tilting moment and/or an inclined position of the printed product during the delivery, which is carried out by the conveyor of the delivery system.

26. The method according to claim 25, wherein the stop is coupled to the separate drive, and the stop ensures a precisely accurate positioning for each of the printed products by an on-the-fly operation.

27. The method according to claim 25, wherein the conveyor of the delivery system comprises conveyor belts, which, at a beginning, pick up the printed product on both sides of a fold and transport the printed product further in conformity with its format.

28. The method according to claim 25, wherein the stop is equipped directly or indirectly with corresponding sensors which respond to a jam control or to asymmetrical printed-product-related differences in thickness in the flow of the printed products produced, and such information is forwarded to the main controller.

29. A method for operating a system, the system comprising: a transport chain, which is roof-shaped in an upper region, along which one or more printed products being transported astride, collected, and optionally stitched in an intermediate stitching station; a stop, which is adjustable in accordance with a format of a printed product of the printed products being delivered, is arranged in a transport direction of the printed products, and is positioned after the intermediate stitching station along the transport chain, the stop corresponding to a location of delivery of the printed product from the transport chain; an ejector; a cutting apparatus; a delivery system; and a main controller, wherein a cyclic transfer of the printed product during the delivery takes place via the delivery system, the delivery system having in an infeed region a printed product transporter configured to transfer the printed product being delivered, the printed product transporter comprising pivot arms, the pivot arms being controllable according to a measured thickness of the printed product being delivered, wherein the method comprises independently operating at least the transport chain, the stop, the delivery system, the ejector, and the cutting apparatus, the independent operation being controlled by the main controller, and wherein an operative process sequences of the ejector for delivering the printed product are carried out according to the following criteria:

a) a blade of the ejector arranged below the delivery system remains in a neutral position until arrival of a command, which is transmitted by the main controller and which initiates a triggering of the delivery;

b) the ejector starts a movement of the blade from the neutral position in order to consistently transfer the printed product to the delivery system, wherein the triggering is time-dependent on a speed of the transport chain, a format of the printed product, and a manual correction, and wherein the speed of the transport chain has a defined or continuously freely definable speed threshold;

c) above the speed threshold, the speed of the ejector is oriented toward that of the transport chain and/or that of conveyor belts belonging to the delivery system in such a way that, as the speed of the transport chain increases, vertical movement of the ejector upward increases, and wherein the vertical movement of the ejector upward decreases correspondingly when the speed of the transport chain is reduced; and d) below the speed threshold, a movement profile of the ejector is uniformly defined by a minimum speed in order to ensure the transfer of the printed product to the conveyor belts of the delivery system.

30. The method according to claim 29, wherein the blade of the ejector moves to an upper turning point during the delivery of the printed product.

31. The method according to claim 29, wherein the blade of the ejector moves to a lower turning point after completion of the delivery of the printed product.

32. The method according to claim 29, wherein the blade of the ejector assumes the neutral position from a lower turning point.

* * * * *